US008181349B2

(12) United States Patent
Sagawa et al.

(10) Patent No.: US 8,181,349 B2
(45) **Date of Patent: *May 22, 2012**

(54) HAIR CUTTING DEVICE

(75) Inventors: Masayuki Sagawa, Hikone (JP); Yoichi Takaoka, Hikone (JP)

(73) Assignee: Panasonic Corporation, Osaka (JP)

( * ) Notice: Subject to any disclaimer, the term of this patent is extended or adjusted under 35 U.S.C. 154(b) by 277 days.

This patent is subject to a terminal disclaimer.

(21) Appl. No.: 11/420,899

(22) Filed: May 30, 2006

(65) Prior Publication Data

US 2006/0265879 A1 Nov. 30, 2006

(30) Foreign Application Priority Data

May 31, 2005 (JP) ..... 2005-160312

(51) Int. Cl.
*B26B 19/12* (2006.01)
*B26B 19/02* (2006.01)

(52) U.S. Cl. ..... 30/43.92; 30/43.7; 30/43.8; 30/43.9

(58) Field of Classification Search ..... 30/43.92, 30/43.9, 34.1, 43.7, 43.8, 43.91; *B26B 19/04, B26B 19/38*

See application file for complete search history.

(56) References Cited

U.S. PATENT DOCUMENTS

| | | | | |
|---|---|---|---|---|
| 4,065,977 | A * | 1/1978 | Buzzi et al. | 74/49 |
| 4,711,028 | A * | 12/1987 | Bergsma et al. | 30/43.6 |
| 6,317,982 | B1 * | 11/2001 | Andrew | 30/34.1 |
| 6,892,457 | B2 * | 5/2005 | Shiba et al. | 30/43.92 |
| 7,020,966 | B2 | 4/2006 | Shiba et al. | |
| 7,461,456 | B2 * | 12/2008 | Tsushio et al. | 30/43.92 |
| 7,464,471 | B2 * | 12/2008 | Fukutani et al. | 30/43.91 |
| 2004/0163257 | A1 | 8/2004 | Morisugi et al. | |
| 2004/0231160 | A1 * | 11/2004 | Shiba et al. | 30/43.92 |
| 2005/0016002 | A1 | 1/2005 | Fukutani et al. | |
| 2006/0021228 | A1 * | 2/2006 | Shiba et al. | 30/43.92 |

FOREIGN PATENT DOCUMENTS

| | | |
|---|---|---|
| EP | 1404494 | 10/2004 |
| GB | 2266070 | 10/1993 |
| JP | 2002-325984 | 11/2002 |
| JP | 2003-117268 | 4/2003 |
| JP | 2004-016527 | 1/2004 |
| KR | 2004-0062619 | 7/2004 |

OTHER PUBLICATIONS

English language Abstract of JP 2003-117268.
English language abstract of JP 2004-016527.
U.S. Appl. No. 11/420,861 to Sagawa, filed May 30, 2006.

* cited by examiner

*Primary Examiner* — Ghassem Alie
*Assistant Examiner* — Bharat C Patel
(74) *Attorney, Agent, or Firm* — Greenblum & Bernstein, P.L.C.

(57) ABSTRACT

A gap between a main body grip portion and a head portion is reduced while securing a tiltable range of the head portion with respect to the main body grip portion. A hair cutting device includes the head portion provided at its upper end surface with a blade head, and the main body grip portion which supports the head portion such that the head portion can vertically float and tilt. A lower portion of the head portion is accommodated in an opened space formed in an upper portion of the main body grip portion, the head portion includes a neck portion whose lower side width in the tilting direction is wider than an upper side width, the neck portion is located at a portion of an opening formed in an upper end surface of the main body grip portion.

7 Claims, 13 Drawing Sheets

HAIR CUTTING DEVICE

CROSS REFERENCE TO RELATED APPLICATION

This application is based upon and claims the benefit of priority from a Japanese Patent Application No. TOKUGAN 2005-160312, filed on May 31, 2005; the entire contents of which are incorporated herein by reference.

BACKGROUND OF THE INVENTION

1. Field of the Invention

The present invention relates to a hair cutting device such as an electric shaver and a depilator for cutting hair.

2. Description of the Related Art

In a hair cutting device such as an electric shaver and a depilator, a head portion provided at its upper end surface with a blade head for cutting hair is supported by a main body grip portion such that the head portion can vertically float and can tilt, so that a contact pressure between the blade head and a skin is appropriately maintained and the blade head moves along the skin (Japanese Patent Application Laid-open No. 2004-016527).

According to such a hair cutting device, when the head portion projects from an upper end opening of the main body grip portion, if a sufficient gap is not secured between an edge of the opening of the main body grip portion and a portion of the head portion which is located inside of the opening, the head portion cannot tilt.

However, since the gap becomes a cause of ingress of shaved beard or moustache into the main body grip portion, it is desired to make the gap small while securing a large tilting range.

SUMMARY OF THE INVENTION

The present invention has been achieved in view of the conventional problem, and it is an object of the invention to provide a hair cutting device capable of making a gap between a main body grip portion and a head portion small while largely securing a tilting range of a head portion with respect to the main body grip portion.

To solve the above problem, the present invention provides a hair cutting device including a head portion provided at its upper end surface with a blade head for epilating hair, and a main body grip portion which supports the head portion in a manner that the head portion can vertically float and tilt, wherein a lower portion of the head portion is accommodated in an opened space formed in an upper portion of the main body grip portion, the head portion is supported in the opened space such that the motion is permitted, the head portion includes a neck portion whose lower side width in the tilting direction is wider than an upper side width, the neck portion is located at a portion of an opening formed in an upper end surface of the main body grip portion.

With this configuration, it is possible to reduce the gap between the main body grip portion and the head portion while largely securing the tiltable range of the head portion with respect to the main body grip portion.

It is preferable that a lower end of the head portion located lower than the neck portion has a width in the tilting direction smaller than the neck portion. The tiltable range of the head portion can be secured largely while suppressing the width of the main body grip portion.

It is preferable that the head portion is supported such that the head portion can laterally tilt, an annular member is mounted on an outer surface of the head portion at a position lower than the neck portion, left and right two shaft-bushing portions respectively provided on a front surface and a back surface of the annular member are supported by a bearing formed on an inner surface of the opened space of the main body grip portion such that the shaft-bushing portions can turn and vertically move, and spring receivers provided on left and right ends of the annular member receive a push-up spring which biases the head portion upward. With this configuration, the head portion can be supported by the main body grip portion with a simple part configuration.

Particularly, it is preferable that the annular member is made of a material that is different from those of a hull of the head portion and a hull of the main body grip portion, the annular member also functions as a slide guide member which comes into slide contact with an inner surface of the opened space of the main body grip portion and guides the motion of the head portion with respect to the main body grip portion. With this configuration, it becomes easy to support the head portion while suppressing unnecessary motion.

DETAILED DESCRIPTION OF THE PREFERRED EMBODIMENTS

Figure 1:
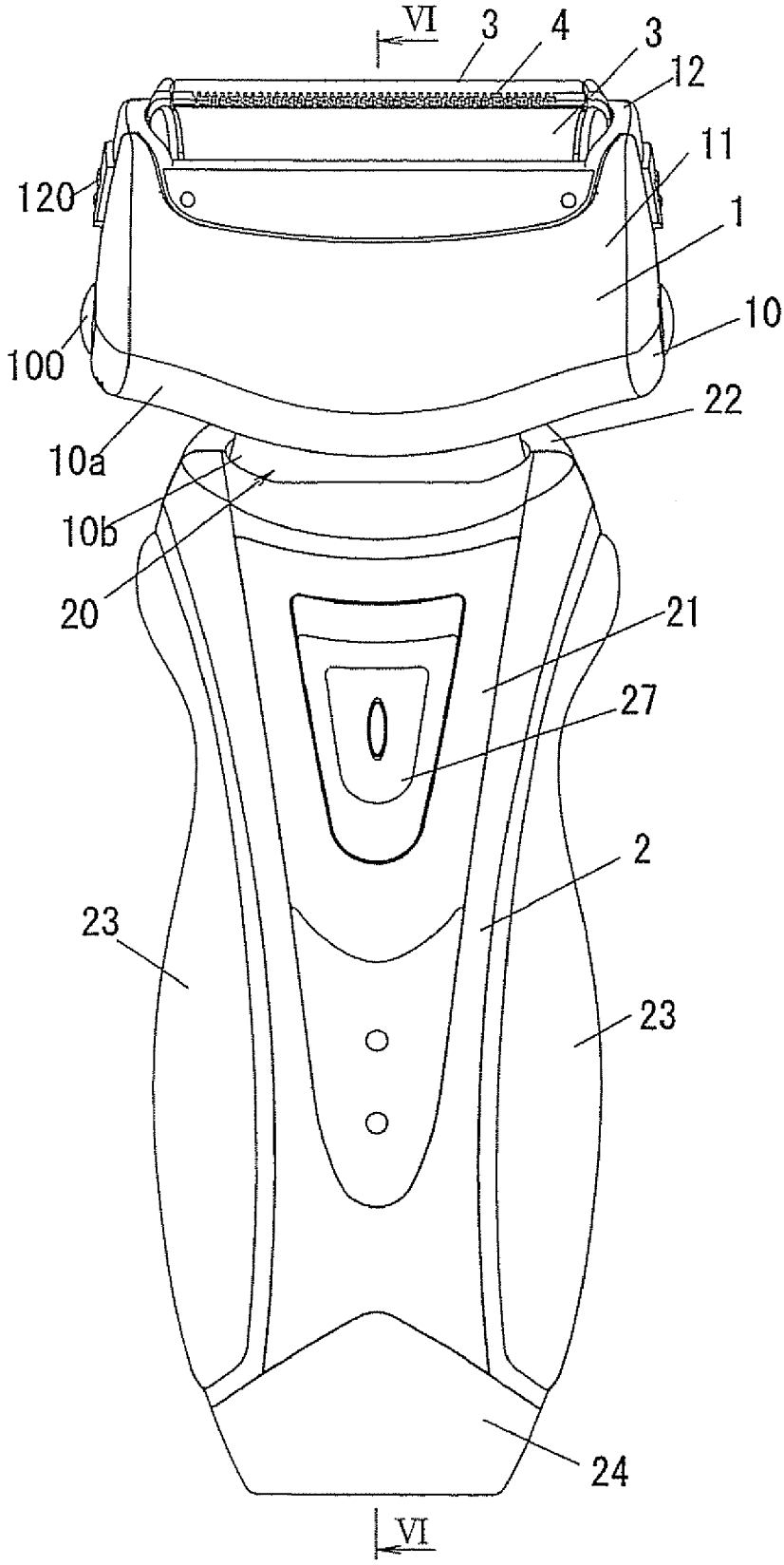
FIG. 1 is a front view of one example of an embodiment of the present invention.
Figure 2:
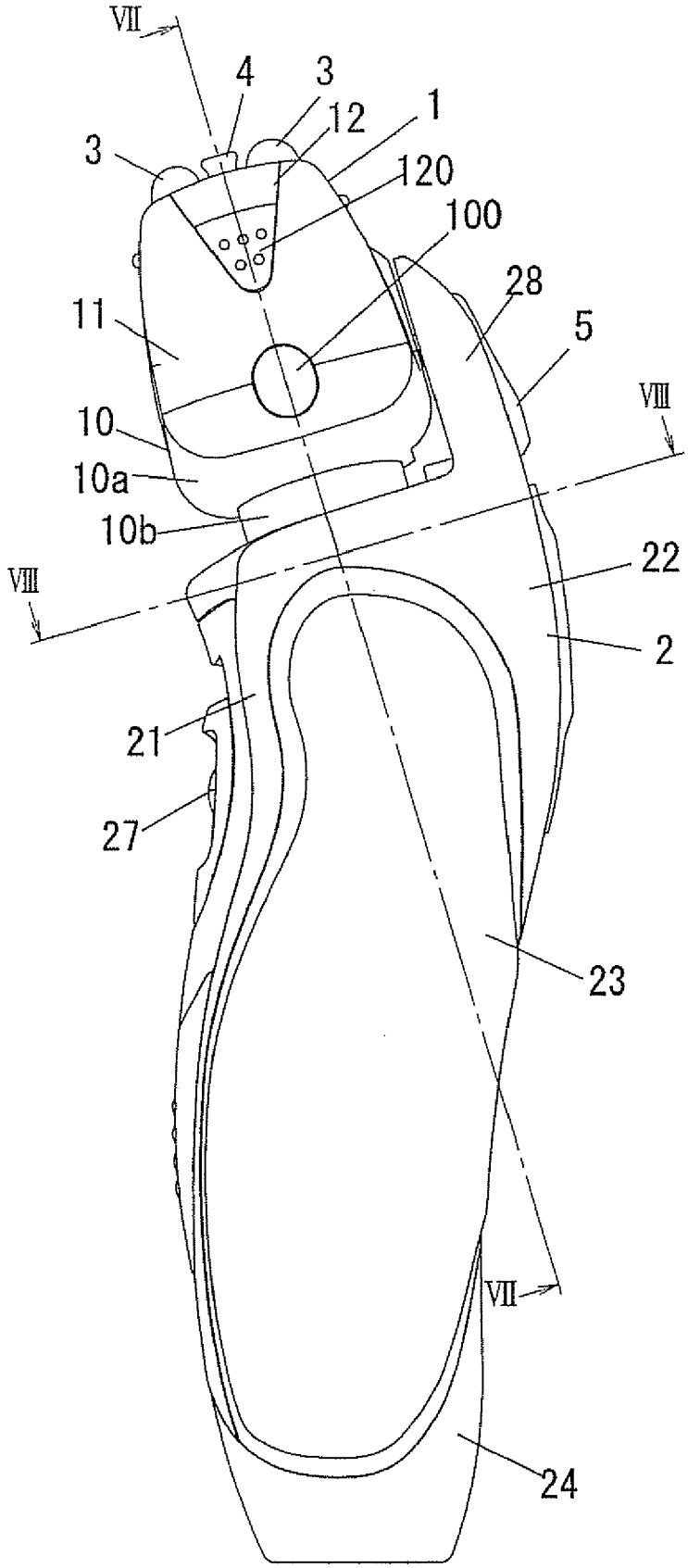
FIG. 2 is a right side view of the example.
Figure 3:
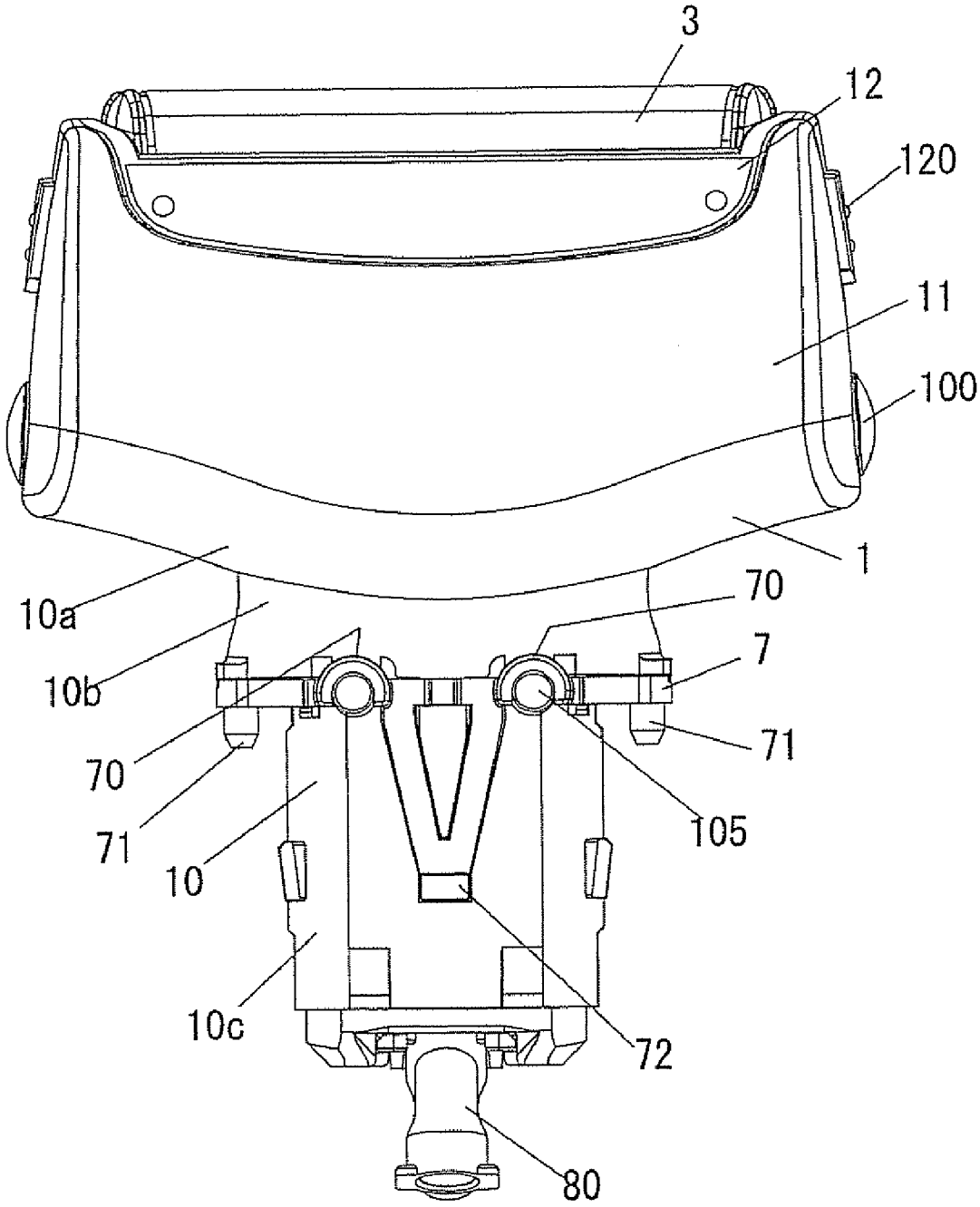
FIG. 3 is a front view of a head portion of the example.
Figure 4:
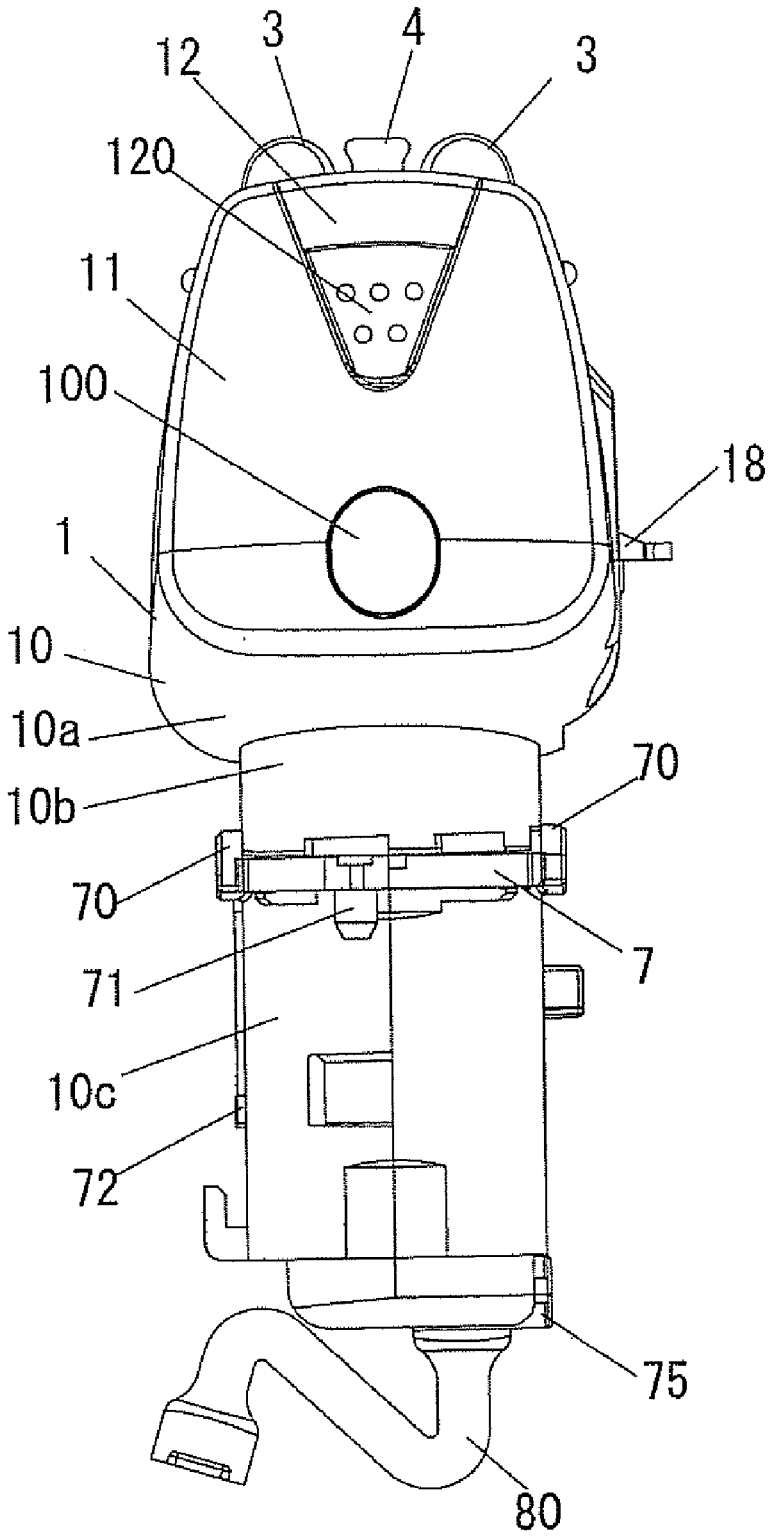
FIG. 4 is a right side view of the head portion.
Figure 5:
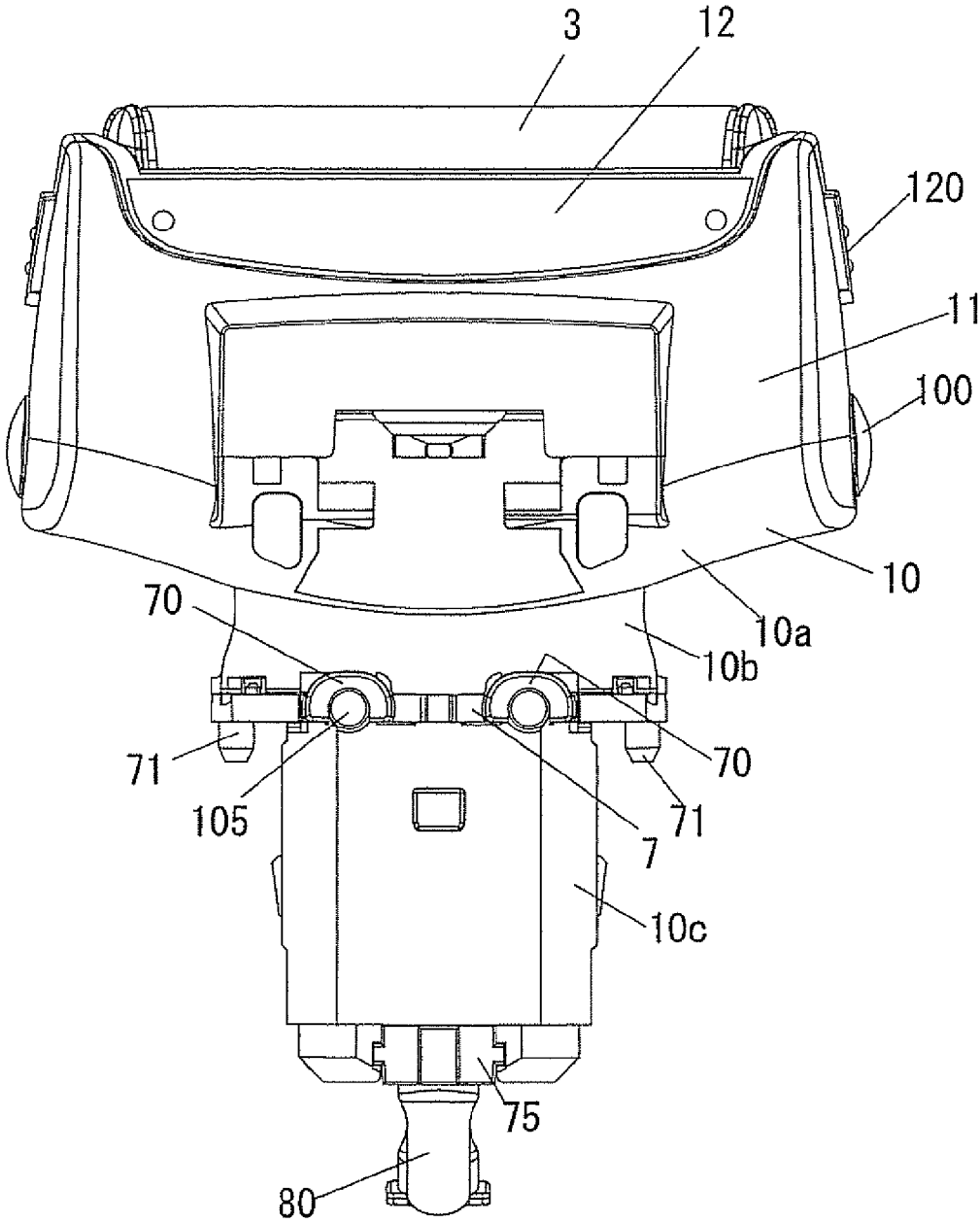
FIG. 5 is a rear view of the head portion.

The present invention is explained below based on embodiments shown in the accompanying drawings. A hair cutting device shown in the drawings is an electric shaver. The electric shaver includes a head portion 1 and a main body grip portion 2. The head portion 1 is provided at its upper end surface with a plurality of blade heads 3, 4 and 3. The main body grip portion 2 vertically movably and laterally tiltably supports the head portion 1. As shown in FIGS. 3 to 5 and 12, the head portion 1 includes a base portion 10, a holding frame 11 which is detachably disposed on the base portion 10, and a mounting frame 12 which is detachable from and attachable to the holding frame 11. The blade heads 3, 4 and 3 are mounted on the mounting frame 12. A reference numeral 100 represents a button for attaching and detaching the holding frame 11 provided on the base portion 10, and a reference numeral 120 represents a button provided on the mounting frame 12 for attaching and detaching.

Figure 12:
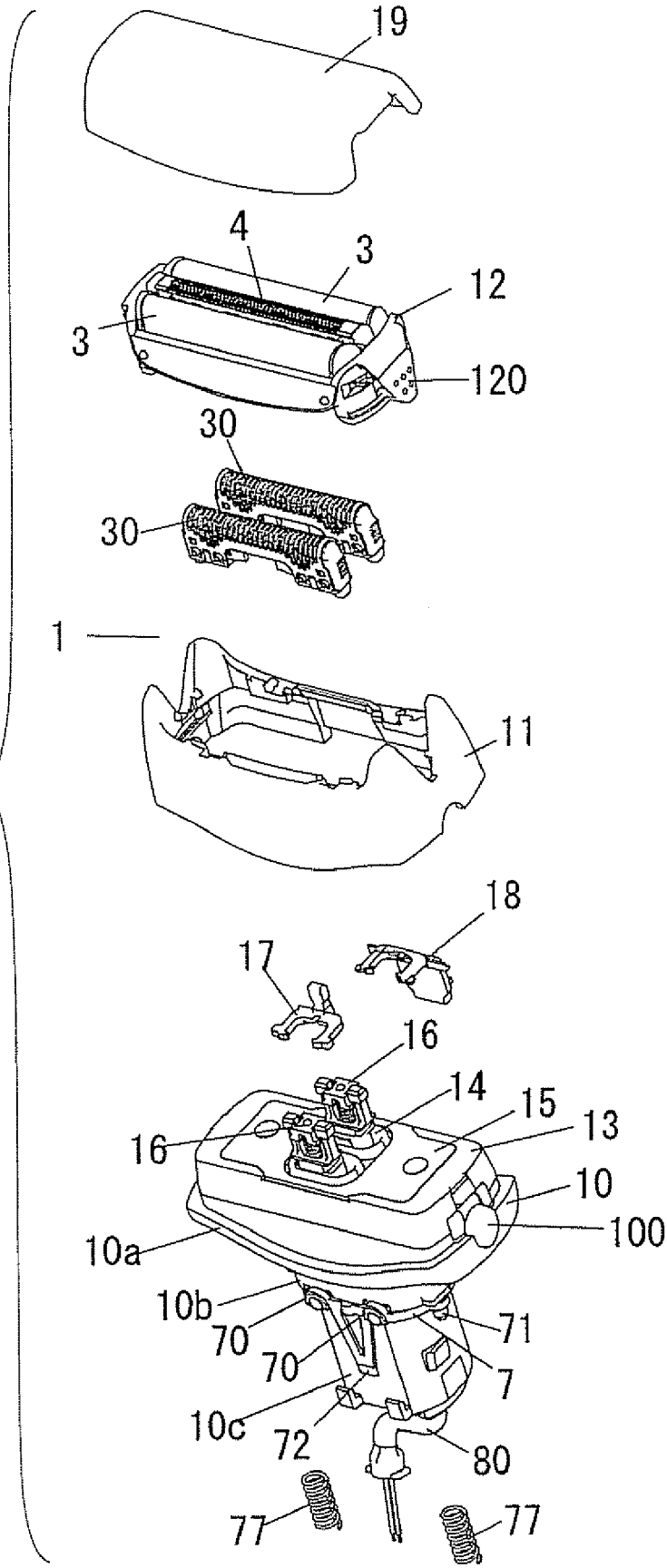
FIG. 12 is an exploded perspective view of the head portion of the example.

The base portion 10 includes an upper wide portion 10*a*, a lower small-diameter portion 10*c* and a neck portion 10*b* located therebetween. An upper end opening of the base portion 10 is closed with a cover 13 shown in FIG. 12. Portions of two drive elements 16 and 16 disposed in the wide portion 10*a* of the base portion 10 are inserted through a central portion of the cover 13 and project upward. In FIG. 12, a reference numeral 14 represents a waterproof rubber for making the inserting portion waterproof, and a reference numeral 15 represents a fixing plate for fixing the waterproof rubber 14.

The drive elements 16 and 16 are accommodated in a wide portion 10*a* of the base portion 10. The drive elements 16 and 16 receive rotation output of a motor 8 accommodated in a small-diameter portion 10*c* through eccentric shafts 81 and 82 and convert the same into lateral reciprocating motion. Inner blades 30 and 30 in the blade heads 3 and 3 are respectively connected to portions of the drive elements 16 and 16 projecting upward from the cover 13. A connecting element 17 is connected to one of the drive elements 16 and 16 for reciprocating the inner blade of the blade head 4. A connecting element 18 is mounted on the other drive element 16 for driving a trimmer blade. A reference numeral 19 in FIG. 12 represents a blade protection cover.

Figure 11:
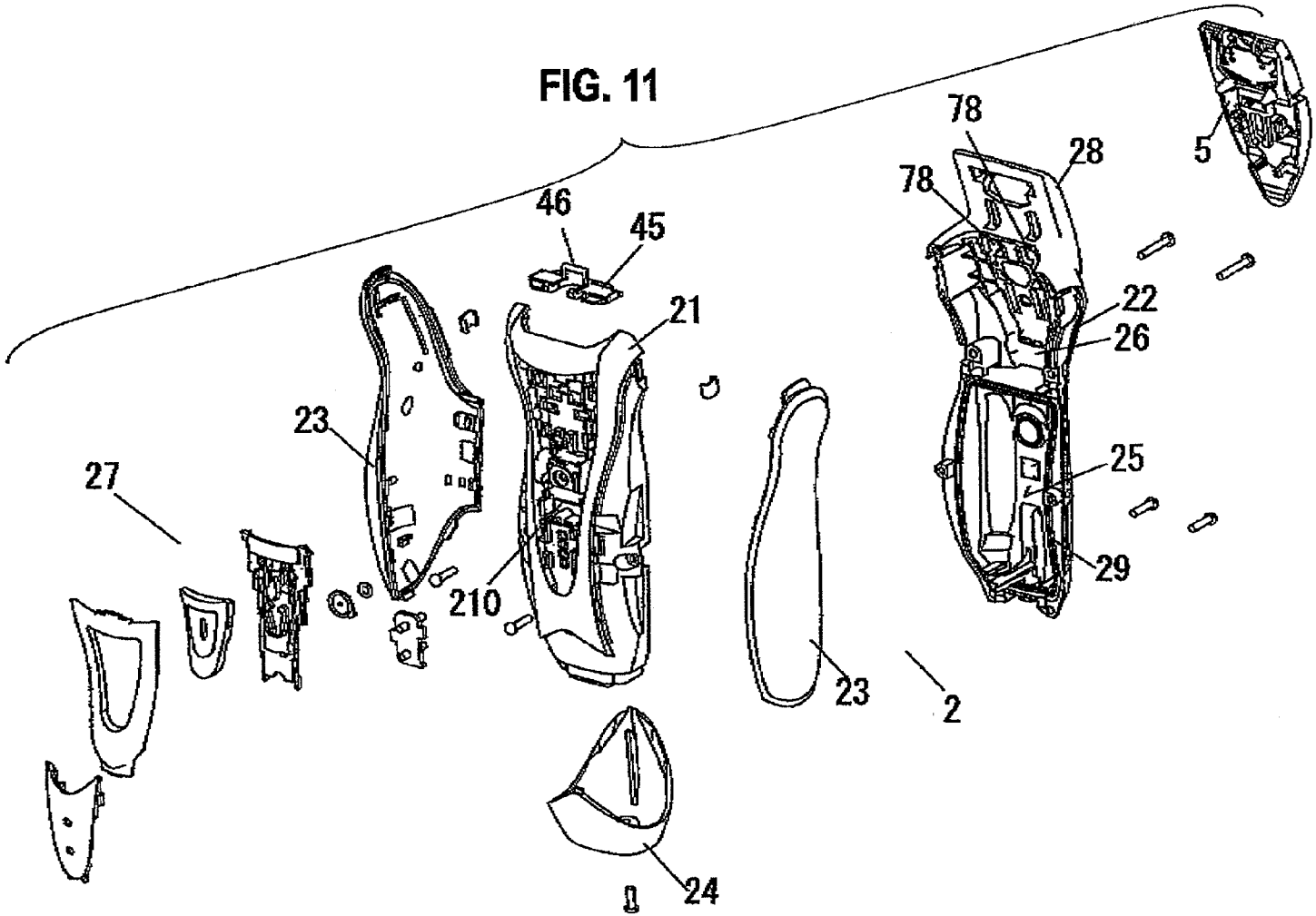
FIG. 11 is an exploded perspective view of a main body grip portion of the example.

As shown in FIG. 11, the main body grip portion 2 includes longitudinally divided two housings 21 and 22, non-slip covers 23 and 23 which are put on left and right side surfaces of the housings 21 and 22, and a lower cover 24 which is put on lower ends of the housings 21 and 22. A switch block 27 is disposed on a front surface of the main body grip portion 2, and a trimmer blade block 5 is located on a back surface of the main body grip portion 2. The trimmer blade block 5 is disposed on an outer surface of a support piece 28 which rises from an upper portion of the housing 22. If a lower handle portion is slid upward, an upper blade portion turns and projects. At that time, the trimmer blade block 5 is connected to the connecting element 18 and the reciprocating motion is transmitted.

Figure 6:
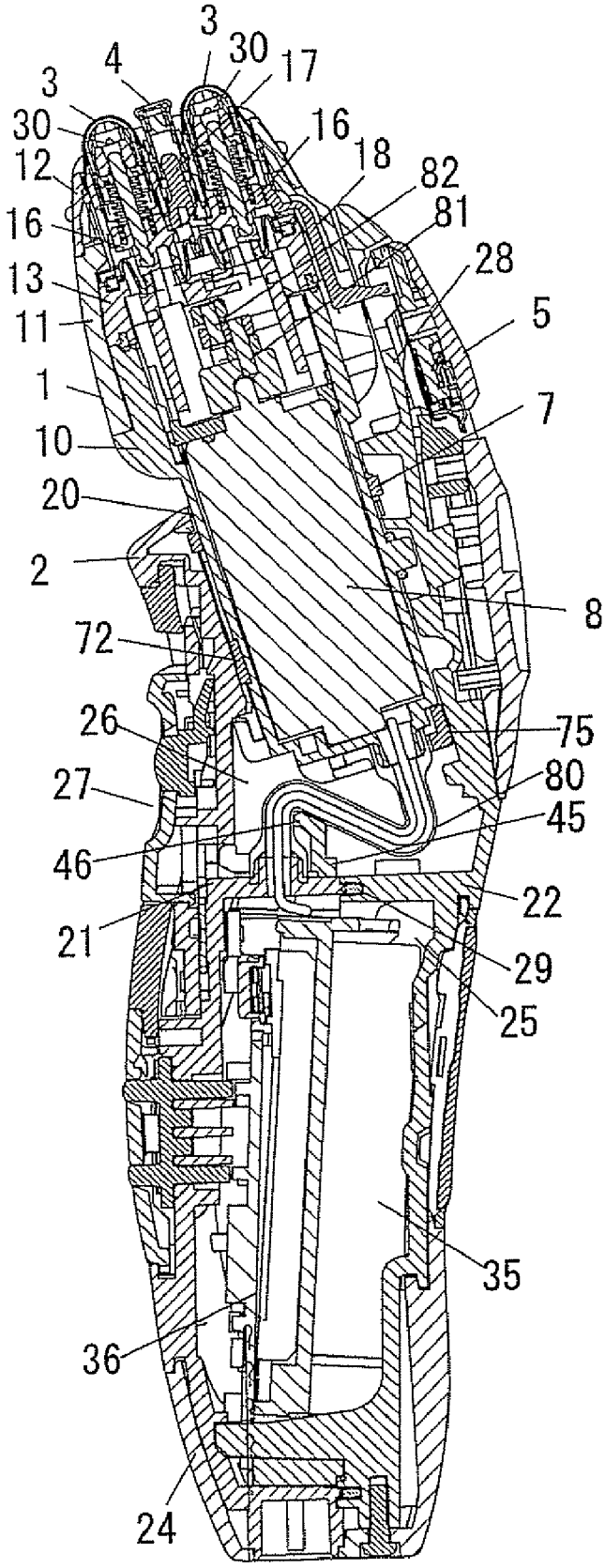
FIG. 6 is a vertical sectional view (taken along the line A-A in FIG. 1) of the example.

An interior space of the main body grip portion 2 is divided into an upper opened space 26 and a lower hermetic space 25. A secondary battery 35 and a circuit block 36 shown in FIG. 6 are accommodated in the hermetic space 25 which is made waterproof by an O-ring 29.

The upper opened space 26 of the main body grip portion 2 is a space in which the small-diameter portion 10*c* of the head portion 1 is accommodated, and is a space which supports the head portion 1 such that the head portion 1 can vertically move and laterally tilt. The housings 21 and 22 are provided at their inner surfaces with receiving grooves 78 and 78 which receives shaft-bushing portions 70 and 70 respectively provided on left and right side of upper front and rear surfaces of the small-diameter portion 10*c*. The housing 21 is provided at its inner surface with spring receivers 217 and 217 which receive lower ends of a pair of left and right push-up springs 77 and 77. The receiving grooves 78 and 78 permit rotations of the shaft-bushing portions 70 and 70, and permit vertical motions of the shaft-bushing portions 70 and 70.

Upper ends of the push-up springs 77 and 77 are received by spring receivers 71 and 71 located on left and right lower end surfaces of the neck portion 10*b* of the head portion 1. Therefore, the head portion 1 is biased upward by the push-up springs 77 and 77.

If the head portion 1 is pushed into the main body grip portion 2, the head portion 1 sinks into the main body grip portion 2 against the biasing forces of the push-up springs 77 and 77. If one of left and right sides of the head portion 1 is pushed, the head portion 1 is tilted around the shaft-bushing portion 70 located on the other side while compressing the one push-up spring 77. The reason why the width of the small-diameter portion 10*c* is smaller than the neck portion 10*b* is that the lateral tilting range of the head portion 1 can be increased while reducing the width of the main body grip portion 2.

Portions of the head portion 1 which come into contact with the main body grip portion 2 are limited to three portions of the front surface and three portions of the back surface of the head portion 1 so as to make the above-described motion of the head portion 1 smooth and not to generate rattle. The three portions of the back surface are the two shaft-bushing portions 70 located on left and right sides of the upper portion of the small-diameter portion 10*c* and a contact portion 75 located on a lower end of a back surface of the small-diameter portion 10*c*. The three portions of the front surface are the two shaft-bushing portions 70 located on left and right sides of the upper portion of the small-diameter portion 10*c* and a contact portion 72 located closer to a lower portion of the front surface of the small-diameter portion 10*c*. When the head portion 1 vertically moves and tilts, these contact portions come into contact with the inner surfaces of the housings 21 and 22, thereby guiding the motion.

When members made of the same material slide against each other, they are worn abruptly. Therefore, such members are made of polyoxymethylene resin (Duracon) or the like, and an annular member 7 mounted on the base portion 10 of the head portion 1 is provided with the four shaft-bushing portions 70 and receivers 71. The contact portion 75 is also made of polyoxymethylene resin (Duracon), and is mounted on a lower end of the back surface of the small-diameter portion 10*c*.

Figure 13:
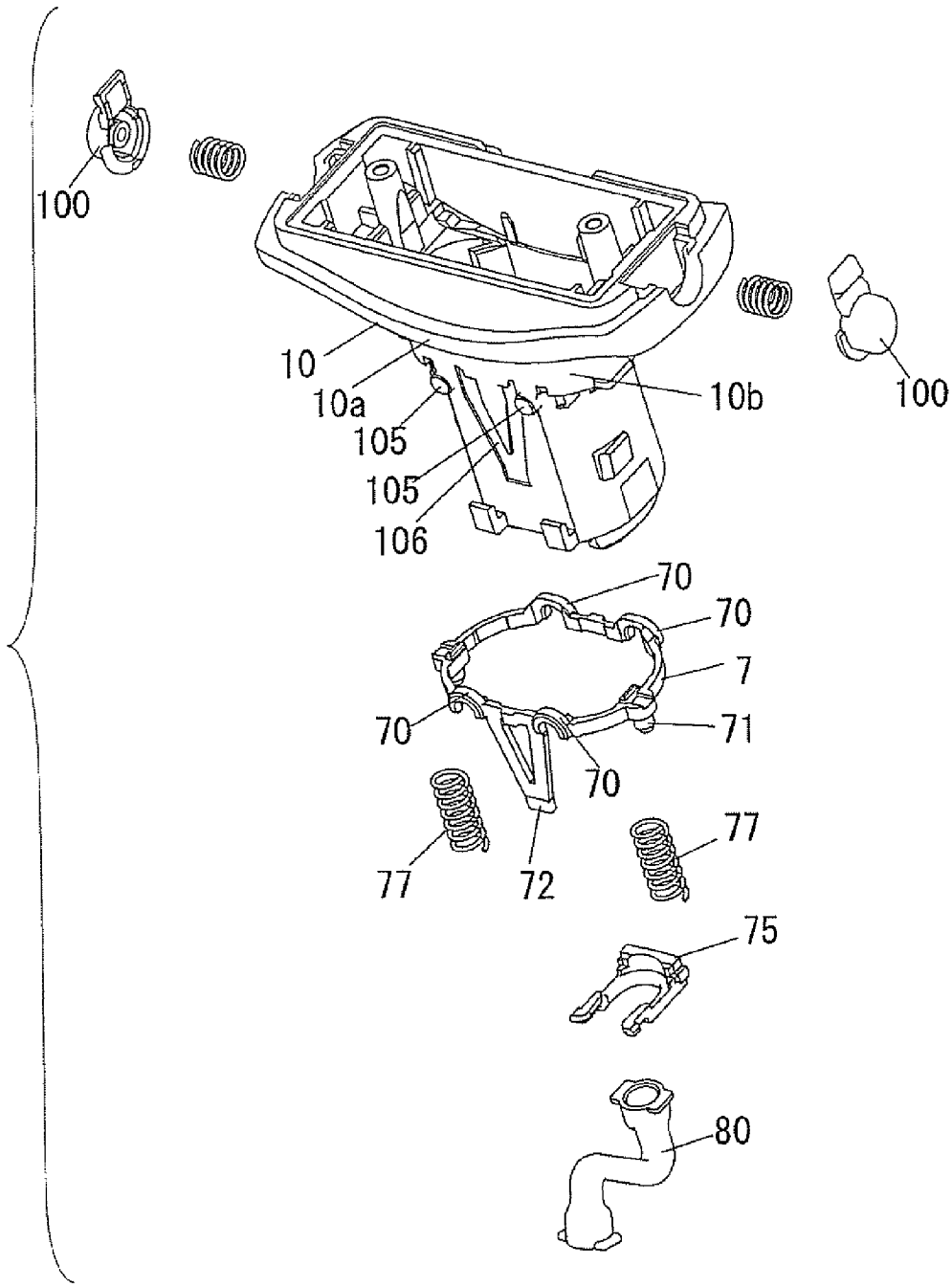
FIG. 13 is an exploded perspective view of a base portion of the head portion.

The annular member 7 is integrally provided with spring receivers 71 and 71 which receive the push-up spring 77 in addition to the four shaft-bushing portions 70 and the contact portion 72 as described above. The annular member 7 is mounted on the base portion 10 from the small-diameter portion 10*c* utilizing resilience of the annular member 7 and margin caused by the gap generated between the portions of the annular member 7 which have the spring receivers 71 and 71 and the small-diameter portion 10*c*. The annular member 7 is positioned and fixed to the base portion 10 by a base 105 which projects from the small-diameter portion 10*c* and engages an inner side of the shaft-bushing portion 70, a groove 106 (see FIG. 13) into which the contact portion 72 is fitted and a lower end surface of the neck portion 10*b*.

Figure 10:
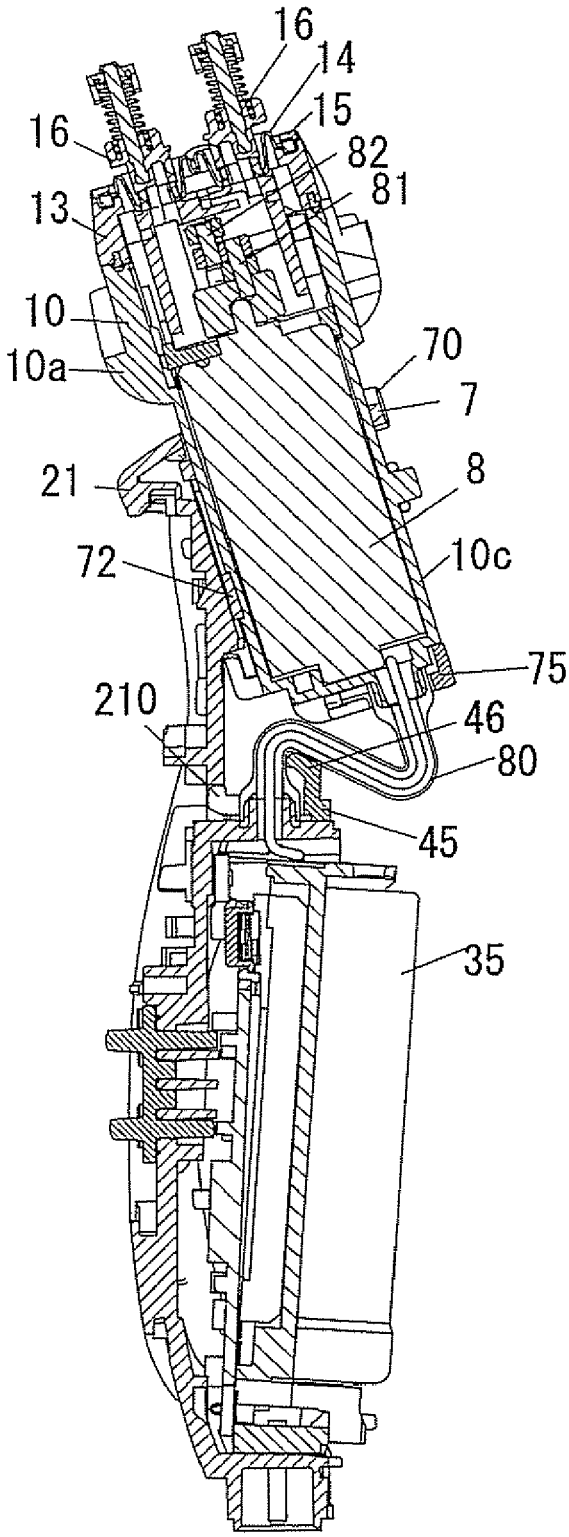
FIG. 10 is a vertical sectional view (taken along the line D-D in FIG. 9) of a state where some parts of the example are removed.

The contact portion 75 is formed as an independent part from the annular member 7. The motor 8 on the side of the head portion 1 and the circuit block 36 on the side of the main body grip portion 2 are connected to each other through a wire. A waterproof tube 80 renders this wire waterproof. The contact portion 75 also functions to fix an end of the waterproof tube 80 close to the head portion 1 to the base portion 10. The contact portion 75 is inserted into the small-diameter portion 10*c* from right side in FIG. 10, a hook on a tip end of the contact portion 75 engages the base portion 10, thereby sandwiching and fixing an end of the waterproof tube 80 between the base portion 10 and the contact portion 75.

The end of the waterproof tube 80 closer to the circuit block 36 is sandwiched and fixed between a partition wall and a pressure plate 45 which is disposed on and fixed to the partition wall between the hermetic space 25 and the opened space 26. A rib 46 rises from the pressure plate 45. The waterproof tube 80 is led out from a lower end surface of the small-diameter portion 10*c* of the base portion 10 which is movable in the opened space 26. The rib 46 provides the waterproof tube 80 with necessary bending state. A window 210 (see FIGS. 10 and 11) brings the opened space 26 and an outer surface of the housing 21. A user can observe, through the window 210, the state of the waterproof tube 80 when the housings 21 and 22 are combined. The window 210 also functions to discharge water which enters the opened space 26.

The head portion 1 can not only vertically move but also laterally tilt with respect to the main body grip portion 2. This is because, if the gap between an open edge 20 at an upper end opening of the main body grip portion 2 through which the head portion 1 is inserted and the neck portion 10*b* which is to be located on the inner peripheral side of the open edge 20 in the head portion 1 is not sufficiently large, the tilting motion of the head portion 1 is impaired. If the gap is excessively large, dusts such as shaved beard or moustache shavings are prone to enter the opened space 26 of the main body grip portion 2 from this gap.

Figure 7:
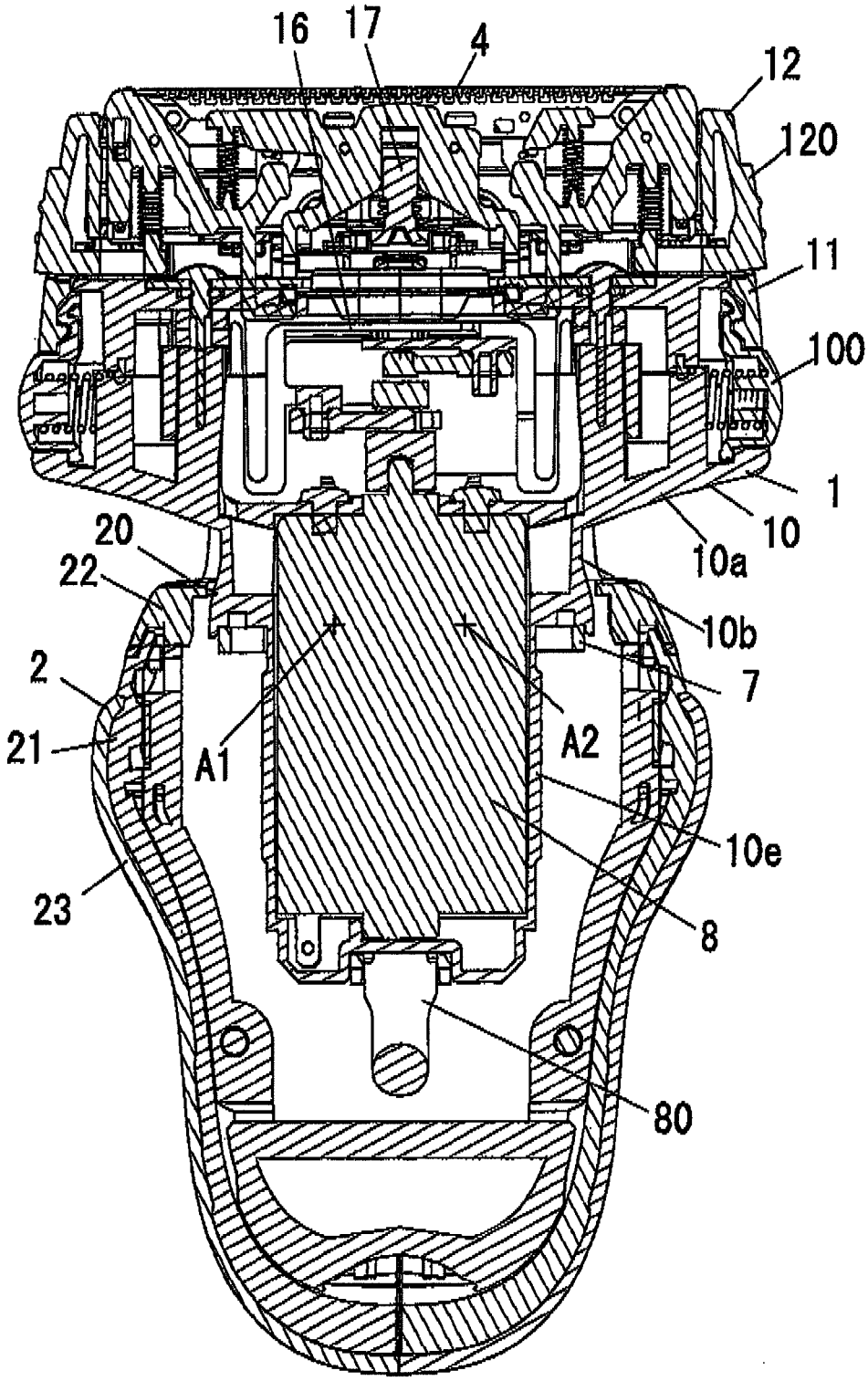
FIG. 7 is a transverse sectional view (taken along the line B-B in FIG. 2) of the example.
Figure 8:
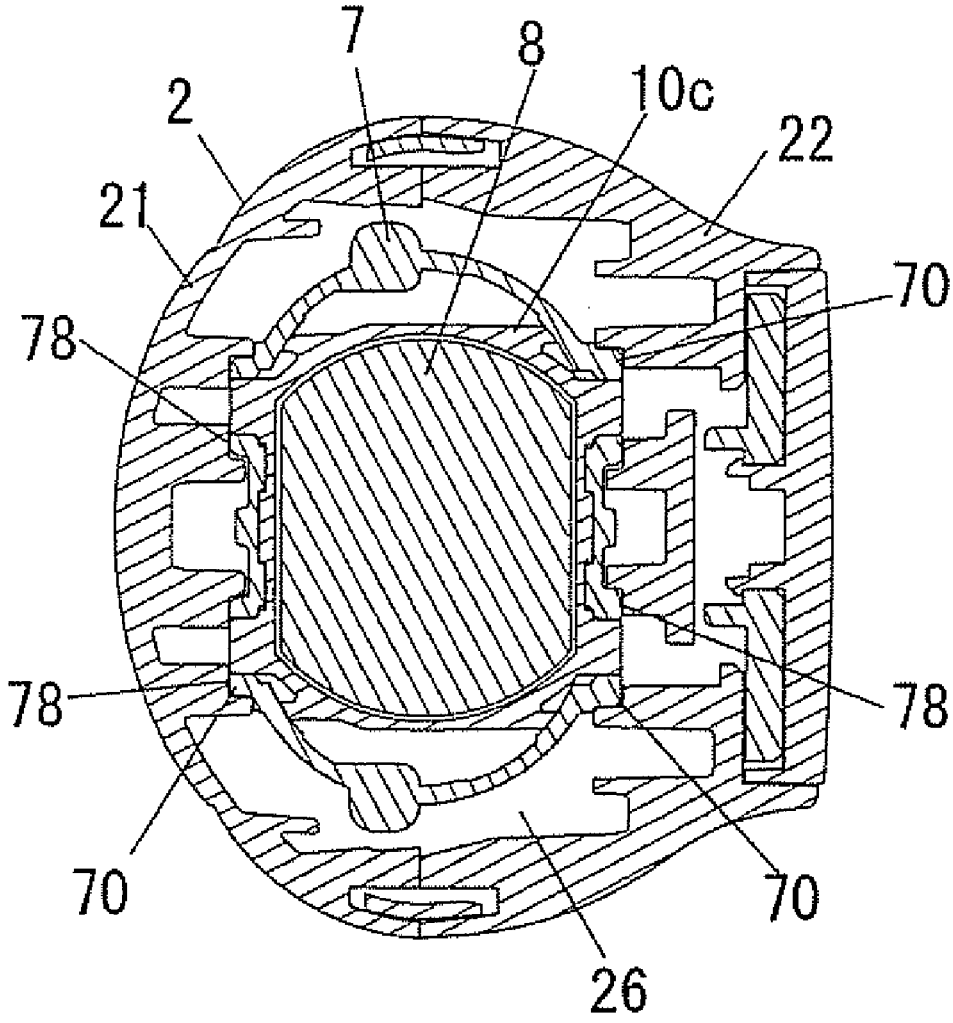
FIG. 8 is a horizontal sectional view (taken along the line C-C in FIG. 2) of the example.
Figure 9:
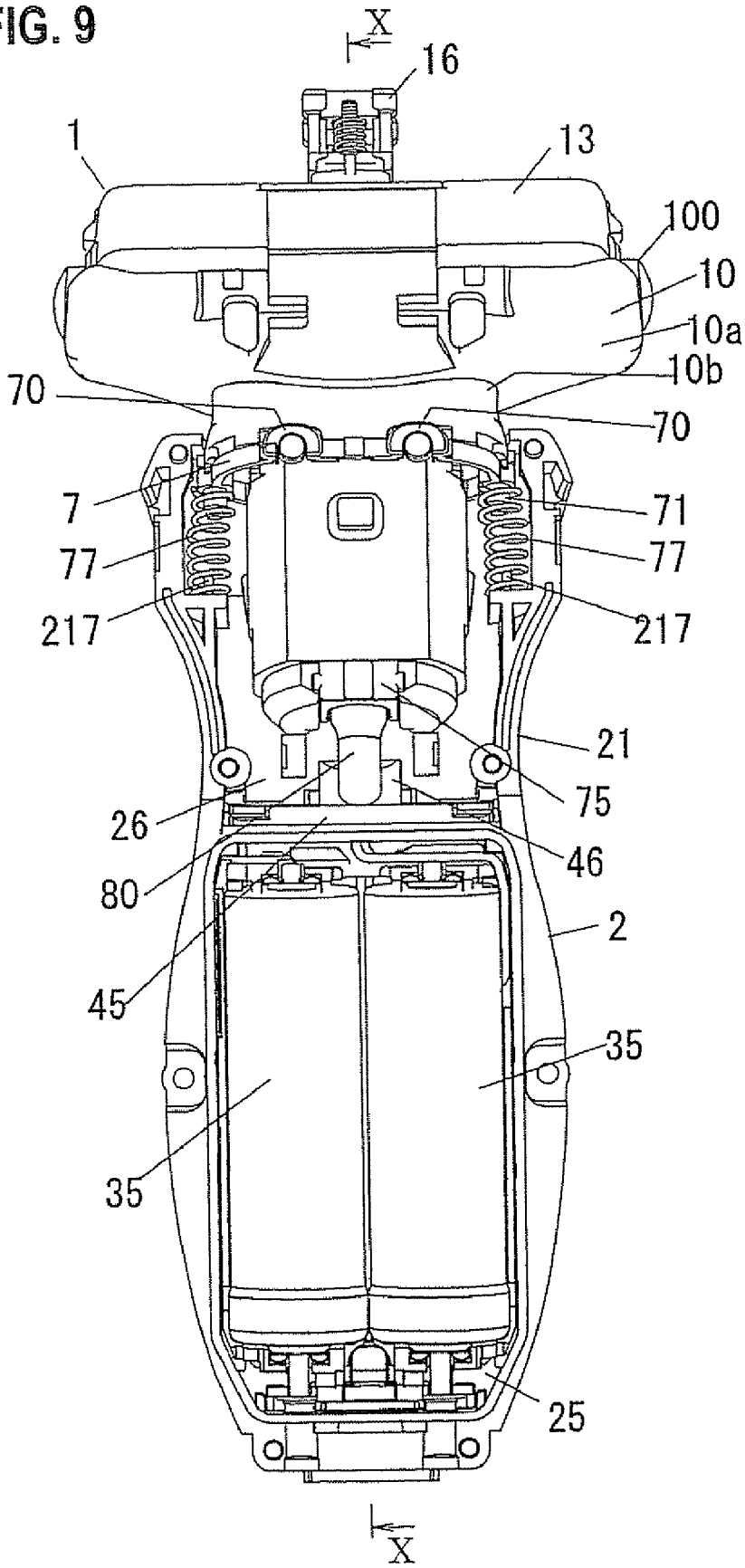
FIG. 9 is a rear view of a state where some parts of the example are removed.

For this end, the left and right shaft-bushing portions 70 which are rotatable about rotational axes A1 and A2 (see FIG. 7) of lateral tilting motion are located lower than the open edge 20. In this configuration, if the neck portion 10*b* has a constant diameter, the gap becomes a maximum when the head portion 1 does not sink. In view of this fact, the neck portion 10*b* is tapered from its lower side toward the upper side. With this configuration, when the head portion 1 sinks straightly, the gap between the open edge 20 and the neck portion 10*b* is increased, but there is no problem because the main motion of the head portion 1 when a user grasps the main body grip portion 2 and pushes the head portion 1 against her or his skin is to slightly tilt in left or right side.

The lower portion of the head portion is accommodated in the opened space of the main body grip portion. The neck portion is tapered from its lower side toward its upper side in the tilting direction. The neck portion is located at the opening of the main body grip portion. Therefore, the gap between the open edge of the main body grip portion and the neck portion of the head portion can be reduced in a state where the tiltable range of the head portion with respect to the main body grip portion is largely secured, and it is possible to lower the possibility that dusts such as shaved beard or moustache enter the main body grip portion from the gap to impair the motion of the head portion.

What is claimed is:

1. A hair cutting device comprising:

a head portion provided at an upper end surface of the hair cutting device with a blade head for epilating hair, and a main body grip portion which supports the head portion in a manner that the head portion can vertically float and tilt, wherein a lower portion of the head portion is accommodated in an opened space formed in an upper portion of the main body grip portion, wherein the head portion is supported in the opened space such that the head portion can vertically float and tilt, and wherein the lower portion of the head portion includes:

a neck portion having a tapered lower side width movable in the tilting direction that is wider than an upper side width of the neck portion such that the tapered lower side width is located inside of and facing an edge of an opening formed in an upper end surface of the main body grip portion, and two left and right shaft-bushing portions, each left and right shaft-bushing portion being provided at one of a front surface and a back surface of the head portion and below the neck portion to permit vertical floating and tilting of the head portion, each of the two shaft-bushing portions being configured to rotate about a rotational axis of tilting of the head portion and the rotational axis being provided below the edge of the opening formed in the upper end surface of the main body grip portion.

2. The hair cutting device according to claim 1, wherein the lower portion of the head portion located lower than the neck portion has a width in the tilting direction smaller than the neck portion.

3. The hair cutting device according to claim 1, wherein the head portion is supported such that the head portion can laterally tilt, wherein an annular member is mounted on an outer surface of the head portion at a position lower than the neck portion, wherein the two left and right shaft-bushing portions respectively provided on a front surface and a back surface of the annular member are supported by a bearing formed on an inner surface of the opened space of the main body grip portion such that the two left and right shaft-bushing portions can turn and vertically move, and wherein spring receivers provided on left and right ends of the annular member receive a push-up spring which biases the head portion upward.

4. The hair cutting device according to claim 3, wherein the annular member is made of a material that is different from material of a hull of the head portion and a hull of the main body grip portion, the annular member is configured as a slide guide member which comes into slide contact with the inner surface of the opened space of the main body grip portion and guides the motion of the head portion with respect to the main body grip portion.

5. The hair cutting device according to claim 2, wherein the head portion is supported such that the head portion can laterally tilt, wherein an annular member is mounted on an outer surface of the head portion at a position lower than the neck portion, wherein the two left and right shaft-bushing portions respectively provided on a front surface and a back surface of the annular member are supported by a bearing formed on an inner surface of the opened space of the main body grip portion such that the two left and right shaft portions can turn and vertically move, and wherein spring receivers provided on left and right ends of the annular member receive a push-up spring which biases the head portion upward.

6. The hair cutting device according to claim 5, wherein the annular member is made of a material that is different from material of a hull of the head portion and a hull of the main body grip portion, the annular member is configured as a slide guide member which comes into slide contact with an inner surface of the opened space of the main body grip portion and guides the motion of the head portion with respect to the main body grip portion.

7. A hair cutting device comprising:

a head portion provided at an upper end surface of the hair cutting device with a blade head for epilating hair, and a main body grip portion which supports the head portion in a manner that the head portion can vertically float and tilt, wherein a lower portion of the head portion is accommodated in an opened space formed in an upper portion of the main body grip portion, wherein the head portion is supported in the opened space such that the head portion can vertically float and laterally tilt, and wherein the lower portion of the head portion includes:

a neck portion having a tapered lower side width in the tilting direction that is wider than an upper side width such that the tapered lower side width is located inside of and facing an edge of an opening formed in an upper end surface of the main body grip portion, and an annular member mounted on an outer surface of the lower portion of the head portion at a position lower than the neck portion, the annular member being operatively connected to the lower portion of the head portion by at least one base which projects from the lower portion of the head portion, wherein the annular member includes at least two left and right shaft-bushing portions, each left and right shaft-bushing portion being provided on one of a front surface and a back surface of the annular member, respectively, wherein the at least two left and right shaft-bushing portions are supported by a bearing formed on an inner surface of the opened space of the main body grip portion such that the at least two left and right shaft-bushing portions can turn and vertically move, and wherein spring receivers provided on left and right ends of the annular member receive a push-up spring which biases the head portion upward.

* * * * *